US012698114B2

(12) United States Patent
Grootherder

(10) Patent No.: US 12,698,114 B2
(45) Date of Patent: Aug. 4, 2026

(54) STACKING DEVICE FOR EGG TRAYS

(71) Applicant: HEDIPACK TECHNOLOGY BEHEER B.V., Brummen (NL)

(72) Inventor: Berend Derk Grootherder, Brummen (NL)

(73) Assignee: HEDIPACK TECHNOLOGY BEHEER B.V., Brummen (NL)

( * ) Notice: Subject to any disclaimer, the term of this patent is extended or adjusted under 35 U.S.C. 154(b) by 87 days.

(21) Appl. No.: 18/863,273

(22) PCT Filed: May 8, 2023

(86) PCT No.: PCT/NL2023/050245
§ 371 (c)(1),
(2) Date: Nov. 5, 2024

(87) PCT Pub. No.: WO2023/214878
PCT Pub. Date: Nov. 9, 2023

(65) Prior Publication Data

US 2025/0320011 A1 Oct. 16, 2025

(30) Foreign Application Priority Data

May 6, 2022 (NL) ..... 2031793

(51) Int. Cl.
*B65G 57/30* (2006.01)
*B65B 23/02* (2006.01)
*B65B 35/50* (2006.01)

(52) U.S. Cl.
CPC ..... *B65B 35/50* (2013.01); *B65B 23/02* (2013.01)

(58) Field of Classification Search
CPC ..... B65G 57/302; B65G 2201/0208; B65B 35/52; B65B 35/50; B65B 23/02
See application file for complete search history.

(56) References Cited

U.S. PATENT DOCUMENTS 3,643,817 A * 2/1972 Rose ..... B65G 57/302 198/468.8
4,787,799 A * 11/1988 Platteschorre ..... B65G 57/302 414/400

(Continued)

FOREIGN PATENT DOCUMENTS

KR 10-2227568 B1 3/2021
KR 10-2022-0009811 A 1/2022

OTHER PUBLICATIONS

International Search Report received in PCT/NL2023/050245, dated Jul. 20, 2023, in 3 pages.

*Primary Examiner* — Andrew M Tecco
(74) *Attorney, Agent, or Firm* — Procopio, Cory, Hargreaves & Savitch LLP

(57) ABSTRACT

The present invention relates to a stacking device for the stacking and unstacking of square egg trays, supplied to under a stacking location, and to be discharged via a discharge conveyor, comprising:

Figure 1A:
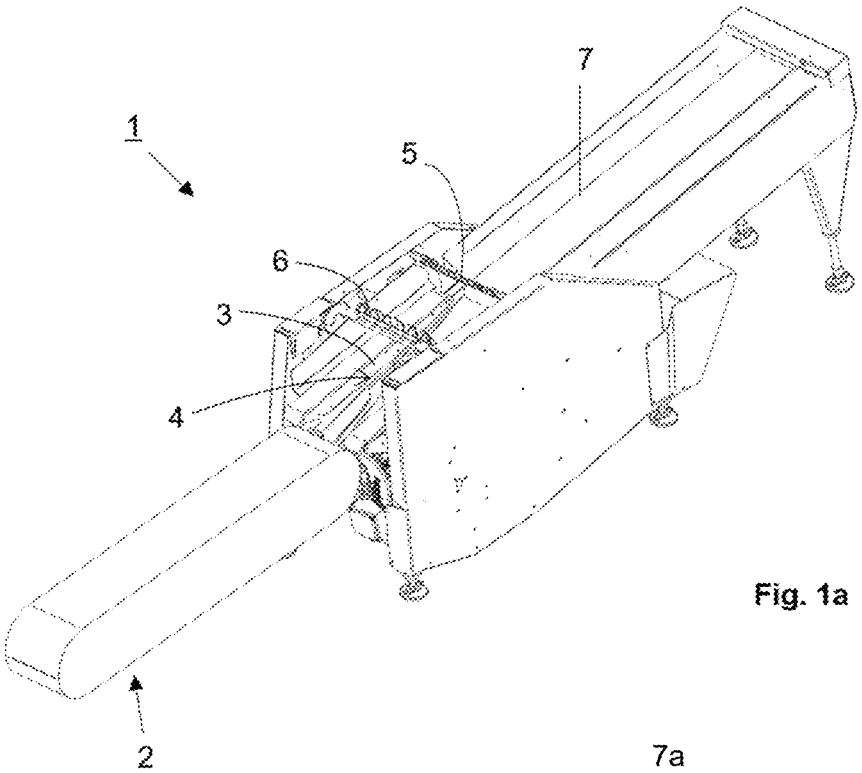

a receiving device for the successive receiving and carrying of egg trays, a stacking device located above the receiving device, comprising a passage that is suitable for transporting the platform loaded with an egg tray through it, and is defined by movable second carrying elements, a lifting device, comprising a platform for bringing an egg tray upward from the receiving device, wherein the stacking device is configured to cause an egg tray filled with eggs, to engage on an underside of a further egg tray the second carrying elements extend at least substantially horizontally and at right angles to the discharge transport direction and are configured to move in a horizontal plane in the transport direction away from each other and toward each other.

(Continued)

The invention also relates to a method for stacking and unstacking egg trays.

18 Claims, 9 Drawing Sheets

(56) References Cited

U.S. PATENT DOCUMENTS

| | | | | |
|---|---|---|---|---|
| 4,955,783 | A * | 9/1990 | Grazia | B65B 35/52 414/795 |
| 4,995,785 | A * | 2/1991 | Platteschorre | B65G 57/302 414/661 |
| 5,232,080 | A * | 8/1993 | van Essen | B65B 65/02 198/418.6 |
| 7,959,402 | B2 * | 6/2011 | Hashinokuchi | B65G 57/302 221/221 |
| 9,499,287 | B2 * | 11/2016 | Koure | B65B 23/02 |
| 11,858,231 | B2 * | 1/2024 | Craig | B31B 50/0044 |
| 2009/0028688 | A1 * | 1/2009 | Hashinokuchi | B65G 57/302 414/798.1 |

* cited by examiner

STACKING DEVICE FOR EGG TRAYS

CROSS-REFERENCE TO RELATED APPLICATIONS

This application is a U.S. national stage application of International Application No. PCT/NL2023/050245, filed May 8, 2023, which claims the benefit of NL 2031793, filed on May 6, 2022, the contents of both of which are incorporated by reference.

The present invention, according to a first aspect, is related to a stacking device that is suitable for the stacking of substantially square egg trays, supplied, or at least to be supplied, via a supply conveyor in a supply transport direction under a stacking location, and to be discharged via a discharge conveyor in a discharge transport direction from the stacking location, comprising:

a receiving device, configured for the successive receiving and carrying of egg trays filled with eggs delivered by the supply conveyor, said receiving device comprising a transit space that is suitable for moving a platform through it, and which is defined on at least two sides by first carrying elements, which, in use, carry edges of an egg tray corresponding to the first carrying elements, a stacking device located above the receiving device at the stacking location, comprising a passage extending substantially in a horizontal plane that is suitable for transporting the platform loaded with an egg tray through it, and that is located above the receiving space, and is defined on at least two sides extending parallel to each other by movable second carrying elements, which during use carry, with the second carrying elements, corresponding edges of an egg tray, and which are configured for increasing and reducing the passage, a lifting device, comprising a platform extending at least substantially horizontally, carried by a carrying device configured for bringing an egg tray upward from the receiving device, wherein the platform has dimensions such that it can pass through the transit space and the passage, wherein the stacking device is configured to cause an egg tray filled with eggs, brought upward from the receiving device by means of the lifting device, to engage with an upper side of the egg tray on an underside of a further egg tray located in the stacking device, then causing the second carrying elements to move in such a way that the egg tray can pass through the passage, then bringing the lifting device with the egg tray(s) thus carried by the platform further upward and then causing the second carrying elements to reduce the passage so that when the lifting device is moved downward, the egg tray is carried by the second carrying elements.

Egg trays are available in various types and sizes. A widely used form is a square egg tray in which eggs are, or at least are to be, packed in a matrix pattern of five rows and six columns. Thirty cups in which the eggs are, or at least are to be, placed are formed as cups with a shape that is midway between an inverted truncated pyramid and an inverted dome. The stacking device according to the present invention has been developed in particular for an egg tray of this kind. It ought to be clear, however, that other shapes of egg trays, for example with a matrix of four by five columns, may also be processed with a device according to the invention, as also occurs with known devices. That is possible because the orientation and the distance apart of the eggs in most cases, even with egg trays that are not square but are for example rectangular, coincides with that in the familiar square five by six egg tray.

Known stacking devices of the type described above have, as second carrying elements, four strips defining a rectangle, each hinged about a horizontal axis. Two second carrying elements are fitted to, and rest on horizontal edges of the stacking location. The other two second carrying elements extend at right angles to the discharge transport direction and rest with their ends on the second carrying elements mentioned in the previous sentence. When an egg tray is brought upward by the lifting device, the lifting device pushes the four second carrying elements upward via the egg tray, so that the passage as it were hinges open on four sides. When the egg tray has passed through the passage sufficiently, the hinged strips fall under gravity down to their original position in which they rest on the edges of the stacking location. Then the lifting device moves downward and the lowest egg tray comes to rest on the four strips. A disadvantage of the known device is that the action of the second carrying elements is fault-prone. The second carrying elements arranged at right angles to the discharge transport direction cannot drop downward earlier than the second carrying elements that are carried by and rest on the edges of the stacking location, because otherwise they tilt downward completely. Furthermore, the known second carrying elements can only carry an egg tray over a narrow bottom edge of an egg tray. Egg trays are often made of bulk material, which is very fragile, and becomes very weak if it gets just a bit wet. This has a considerable negative effect on the carrying capacity of the thin bottom edge of the egg tray. When a stack of egg trays drops downward in the device this produces a lot of rubbish. The device must remain clean, since foodstuffs are being packed by it.

The present invention aims to provide a stacking device of the type disclosed in the preamble that can carry a stack of egg trays in a more reliable manner and is not very fault-prone. This objective is met by the present invention, in that the second carrying elements extend at least substantially horizontally and at right angles to the discharge transport direction and are configured to move in a horizontal plane in the transport direction away from each other and toward each other. The motion of the second carrying elements may be motor-controlled and is therefore less fault-prone than in the known device, wherein the motion of the second carrying elements depends on contact with egg trays, and on gravity. In addition, the invention offers the possibility of positioning the second carrying elements better and the design freedom thereof is greater, so that they can be designed better according to their function. A further advantageous effect is that the passage, in the direction at right angles to the discharge transport direction, only needs to be minimally wider than the corresponding dimension of an egg tray, and that in addition it can remain free from parts moving uncontrollably. Another advantageous effect is that the tray only needs to extend minimally above the horizontal plane of the upper transit space, because the carrying elements move a small distance from each other in the same horizontal plane.

If the second carrying elements are elongated, they can carry an egg tray over a relatively large length, substantially the whole length or width thereof, without needing to be bulky.

It is preferred that the second carrying elements have a longitudinal direction that extends at right angles to the discharge transport direction and a transverse direction which, seen from bottom to top, extend slanting toward each other. The slanting angle preferably corresponds generally with the slanting angle of a corresponding edge of an egg tray to be carried, in such a way that the second carrying elements can engage over a part or in nearly the entire height of the corresponding edge of the egg tray in a reliable way.

Sturdy and reliable engagement is further reinforced if the second carrying elements, on a side extending slanting upward, have a profile corresponding to an inner side of a lateral edge of an egg tray. The second carrying elements may comprise a strip extending, in use, transversely to the discharge transport direction, on which there are for example six lips extending slanting upward.

It is preferred that two first carrying elements extend in the supply transport direction. Thus, the respective two first carrying elements may be mounted in the extension of the supply transport device, so that an egg tray can be pushed as it were by the supply conveyor belt with the lateral edges on the respective two first carrying elements.

In a preferred embodiment, the platform has a rectangular, preferably square perimeter. Said shape corresponds to the shape of the most used five by six egg tray and can thus support it well. However, other shapes are also possible, such as a rectangular shape wherein the length differs from the width, or an octagonal or round shape.

In order to allow the platform to pass through the transit space and the passage, and in particular the first and second carrying elements, the perimeter of the platform has a length and a width that are in each case smaller than the length and width, respectively, of a five by six tray [length width tray], wherein the length and/or width are preferably less than 250 mm, more preferably less than 220 mm.

It is preferred that the platform is provided, on an upper side thereof, with upward-projecting projections, which are configured for being able to engage, in two positions turned 90 degrees about a vertical axis, with an underside of an egg tray that is to be carried. Thus, an egg tray carried on the platform can be carried, aligned more reliably and possibly better aligned relative to an egg tray at the stacking location, and moved to the stacking location.

It is preferred that the carrying device comprises an elongated lifting element extending vertically, provided on the underside of the platform. Accordingly, by means of a lifting drive known per se, an upward and downward motion can be transmitted to the platform easily, and the weight to be transferred can be limited.

If the carrying device is configured for rotating the platform about a vertical axis, the platform can rotate an egg tray through an angle of 90 degrees. This is advantageous, since egg platforms should always be stacked turned 90 degrees relative to each other.

In a preferred embodiment, the discharge transport device comprises an endless belt, on which stacked egg trays are placed. If the stack is up to height, i.e. if the desired number of egg trays has been stacked, the rear carrier remains open and the front holder drops down with it. The stacks are led away like this.

It is preferred that the receiving device and/or the stacking location extend at least substantially in a horizontal plane. However, for example when a supply or discharge transport device is oriented slanting relative to the horizontal, the receiving device and/or the stacking location may extend at an angle relative to the horizontal.

In a preferred embodiment according to the invention, the supply conveyor comprises at least first and second partial conveyors extending at a distance from and parallel to each other, or wherein the supply conveyor comprises three parallel belts, separate from each other, extending parallel to each other through a space, and wherein, between the first and second partial conveyors, or in the two spaces, there are two vertical elements, which in a first supply orientation of an egg tray function as a stop for two cups of the egg tray, and which, in a second discharge orientation of an egg tray, turned 90 degrees relative to the first orientation, are located between two adjacent cups, so that a supplied egg tray is stopped by the vertical elements to be gripped by the lifting device, and stacked egg trays deposited by the lifting device can pass the vertical elements unhindered. An advantage thereof is that the supply conveyor doesn't have to be stopped every time a supplied egg tray is just above the lifting device and that the lifting device doesn't have to be started every time the respective egg tray is lifted from the supply conveyor by the lifting device. Every egg tray is supplied in the same orientation and is rotated 90 degrees under the already stacked egg trays, so the lowermost egg tray of a stack is always 90 degrees rotated with respect to the supply orientation. Because the number of columns of an egg tray always differs one from the number of rows, a vertical element is now located between two adjacent columns, so that the vertical element allows the stacked tray to pass.

The vertical elements may also be applied independently from the first aspect of the invention. The vertical elements are then to be protected as a second invention, defined as:

A stacking device that is suitable for the stacking of substantially square egg trays, supplied, or at least to be supplied, via a supply conveyor in a supply transport direction under a stacking location, and to be discharged via a discharge conveyor in a discharge transport direction from the stacking location, comprising:

a receiving device, configured for the successive receiving and carrying of egg trays filled with eggs delivered by the supply conveyor, said receiving device comprising a transit space that is suitable for moving a platform through it, and which is defined on at least two sides by first carrying elements, which, in use, carry edges of an egg tray corresponding to the first carrying elements, a stacking device located above the receiving device at the stacking location, comprising a passage extending substantially in a horizontal plane that is suitable for transporting the platform loaded with an egg tray through it, and that is located above the receiving space, and is defined on at least two sides extending parallel to each other by movable second carrying elements, which during use carry, with the second carrying elements, corresponding edges of an egg tray, and which are configured for increasing and reducing the passage, a lifting device, comprising a platform extending at least substantially horizontally, carried by a carrying device configured for bringing an egg tray upward from the receiving device, wherein the platform has dimensions such that it can pass through the transit space and the passage, wherein the stacking device is configured to cause an egg tray filled with eggs, brought upward from the receiving device by means of the lifting device, to engage with an upper side of the egg tray on an underside of a further egg tray located in the stacking device, then causing the second carrying elements to move in such a way that the egg tray can pass through the passage, then bringing the lifting device with the egg tray(s) thus carried by the platform further upward and then causing the second carrying elements to reduce the passage so that when the lifting device is moved downward, the egg tray is carried by the second carrying elements, the supply conveyor comprising at least first and second partial conveyors extending at a distance from and parallel to each other, or wherein the supply conveyor comprises three parallel belts, separate from each other, extending parallel to each other through a space, and wherein, between the first and second partial conveyors, or in the two spaces, there are two vertical elements, which in a first supply orientation of an egg tray function as a stop for two cups of the egg tray, and which, in a second discharge orientation of an egg tray, turned 90 degrees relative to the first orientation, are located between two adjacent cups, so that a supplied egg tray is stopped by the vertical elements to be gripped by the lifting device, and stacked egg trays deposited by the lifting device can pass the vertical elements unhindered In a stacking device comprising the at least first and second partial conveyors extending at a distance from and parallel to each other, the vertical elements preferably comprise cams that are hinged toward each other so that in the hinged state they allow egg trays to pass unhindered over the supply conveyor direction of the discharge conveyor. The cams may be pretensioned in the vertical state.

In a preferred embodiment, such a stacking device comprises a third partial conveyor that is configured to be placed between the first and second partial conveyors for forming an at least substantially continuous conveyor belt extending transversely to a transport direction of the supply conveyor. In the state with the three partial conveyors the supply conveyor convey packages that are narrower than the mutual distance between the first and second partial conveyor.

It is preferred, that, in the state in which they are hinged toward each other, the vertical elements are located under the level of belts of the partial conveyors. Therefore, they are no obstacle for egg trays located at the partial conveyors and, in use of the third partial conveyer, the vertical elements may be located under the belt, at least the part of the belt that carries the egg trays, of said third partial conveyor.

According to second aspect, the invention is related to a method for stacking egg trays, comprising the steps of:

supplying an egg tray filled with eggs to a receiving device located under a stacking location of a stacking device and comprising a passage, said receiving device comprising a transit space that is suitable for moving a platform through it, and which is defined on at least two sides by first carrying elements, which, in use, carry edges of an egg tray corresponding to the first carrying elements, moving the egg tray upward toward the stacking device by means of a lifting device, comprising a platform extending at least substantially horizontally, carried by a carrying device, with dimensions such that it can pass through the transit space and the passage, transporting the platform loaded with an egg tray through the passage, wherein the passage, on at least two sides extending parallel to each other, is defined by movable second carrying elements in order to carry edges of an egg tray corresponding to the second carrying elements, causing the egg tray filled with eggs brought upward by means of the lifting device, to engage with an upper side of the egg tray on an underside of a further egg tray located in the stacking device, causing the second carrying elements to move in such a way that the egg tray can pass through the passage, by means of the lifting device, bringing the egg tray carried by the platform further upward, reducing the passage by means of the second carrying elements, moving the lifting device downward, and transferring the egg tray to the second carrying elements, so that it is carried by the second carrying elements, characterized in that the second carrying elements extend at least substantially horizontally and at right angles to the discharge transport direction and, for increasing and reducing the passage, move in a horizontal plane in the transport direction away from each other and toward each other. The invention aims to solve a problem of the prior art corresponding to the first aspect and has advantages that correspond to the first aspect.

It is thereby preferred that herein the egg trays are stacked by means of a stacking device in accordance with the first aspect of the invention.

Figure 1B:
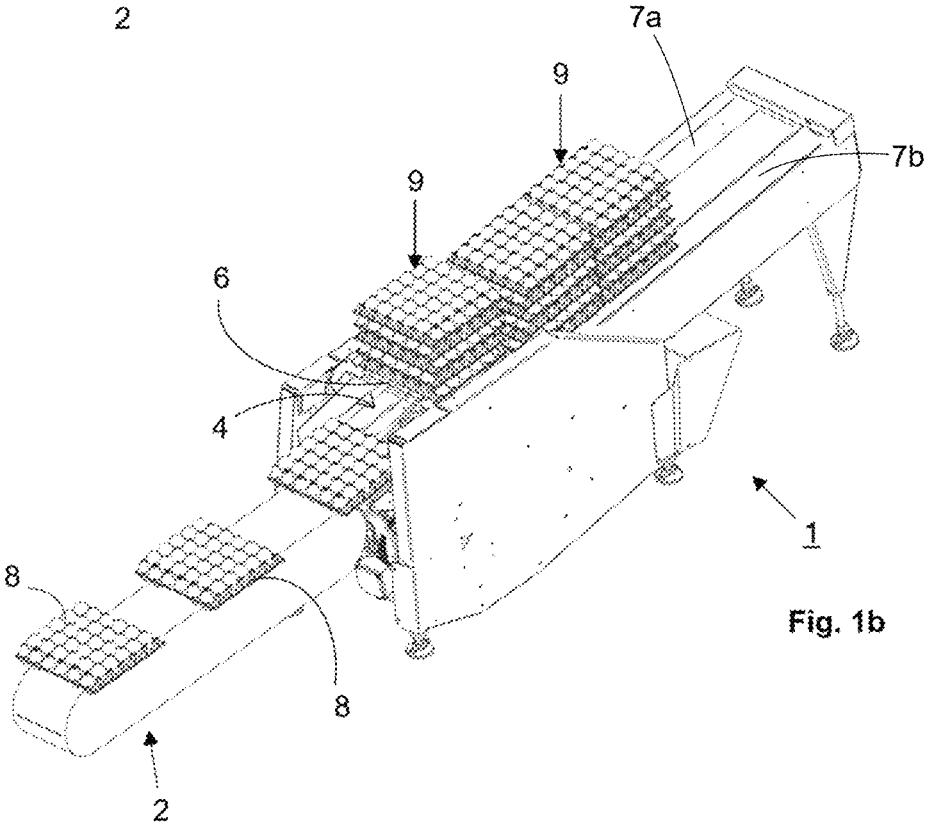
Figure 2A:
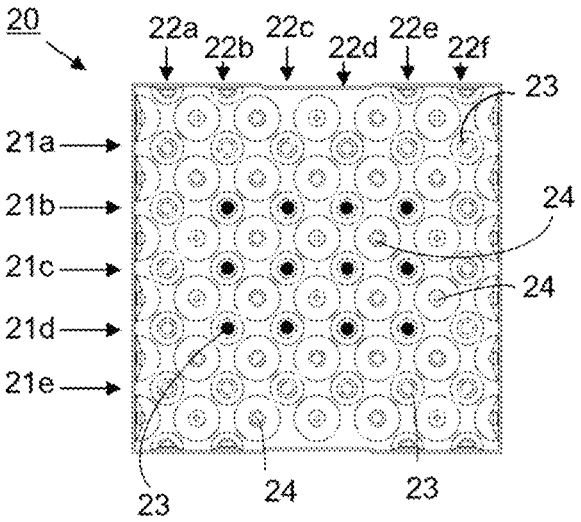
Figure 2B:
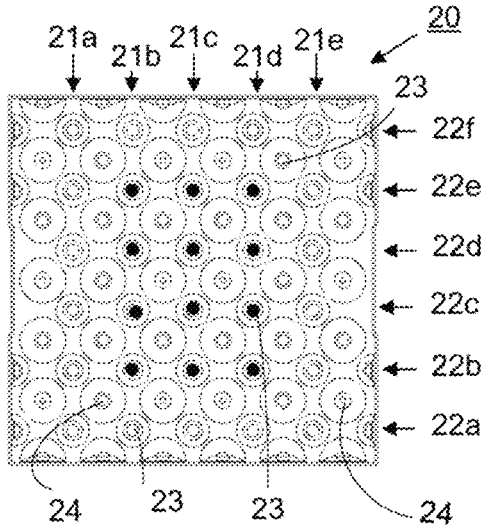
Figure 3A:
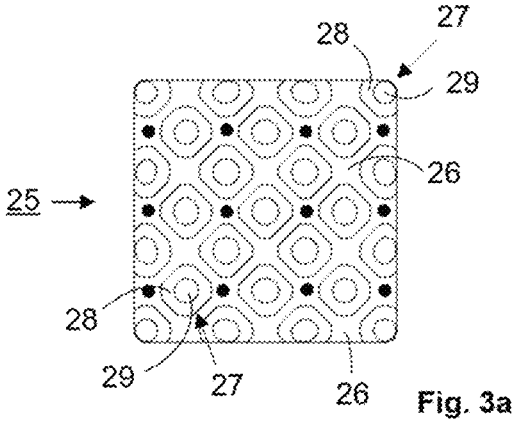
Figure 3B:
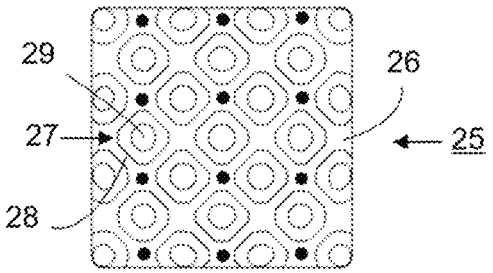
Figure 3C:
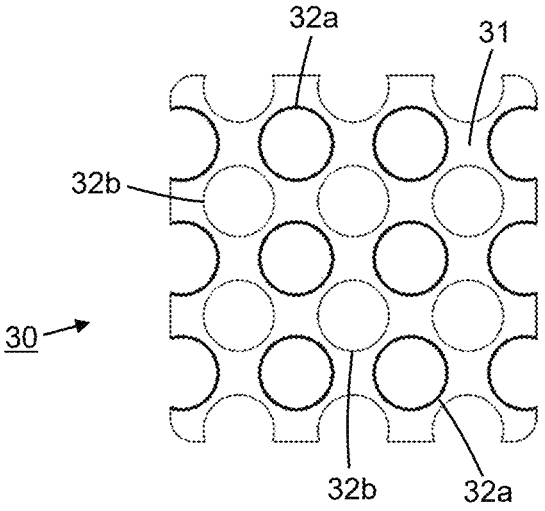
Figure 3D:
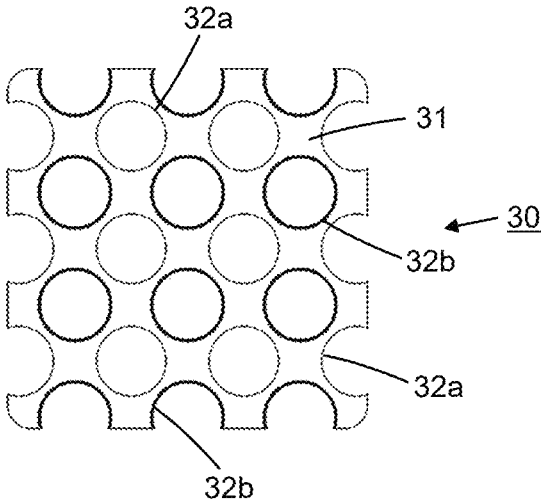
Figure 4A:
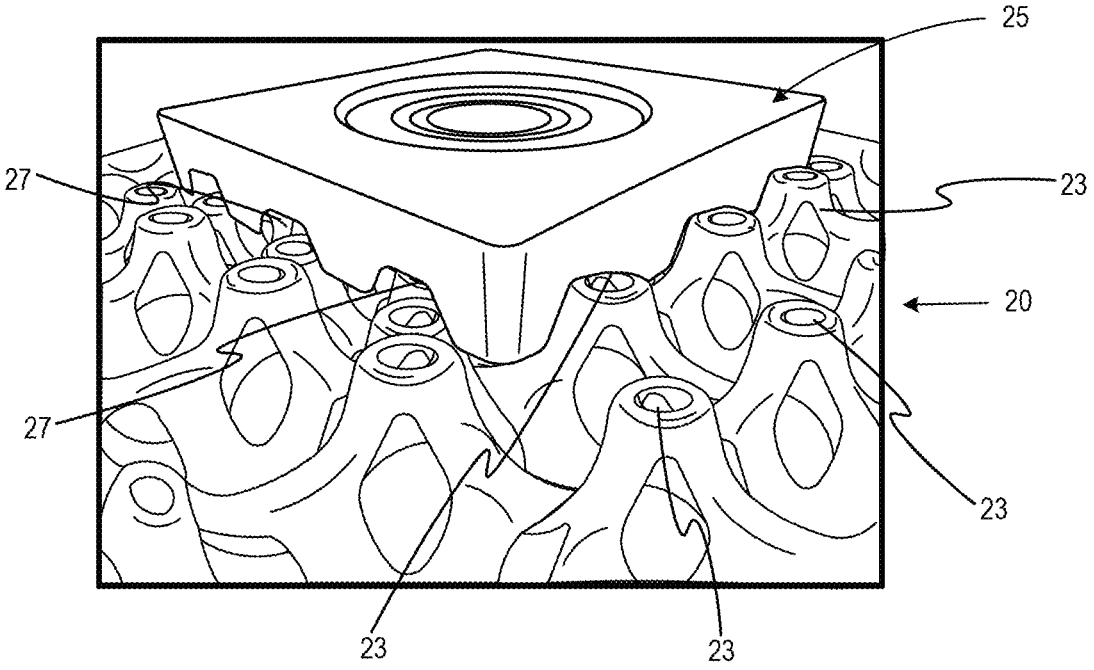
Figure 4B:
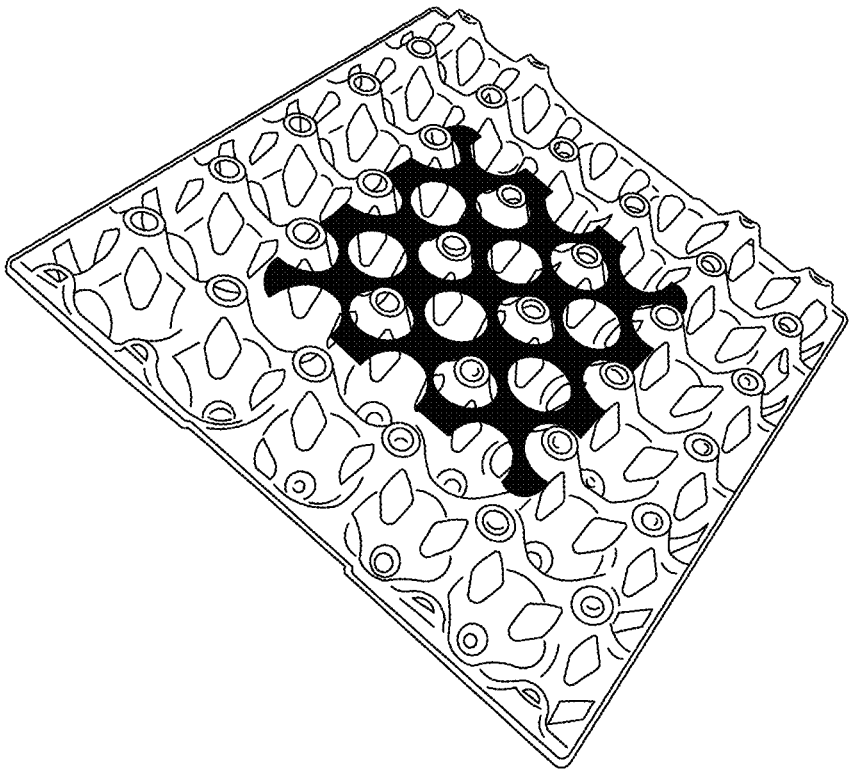
Figure 5:
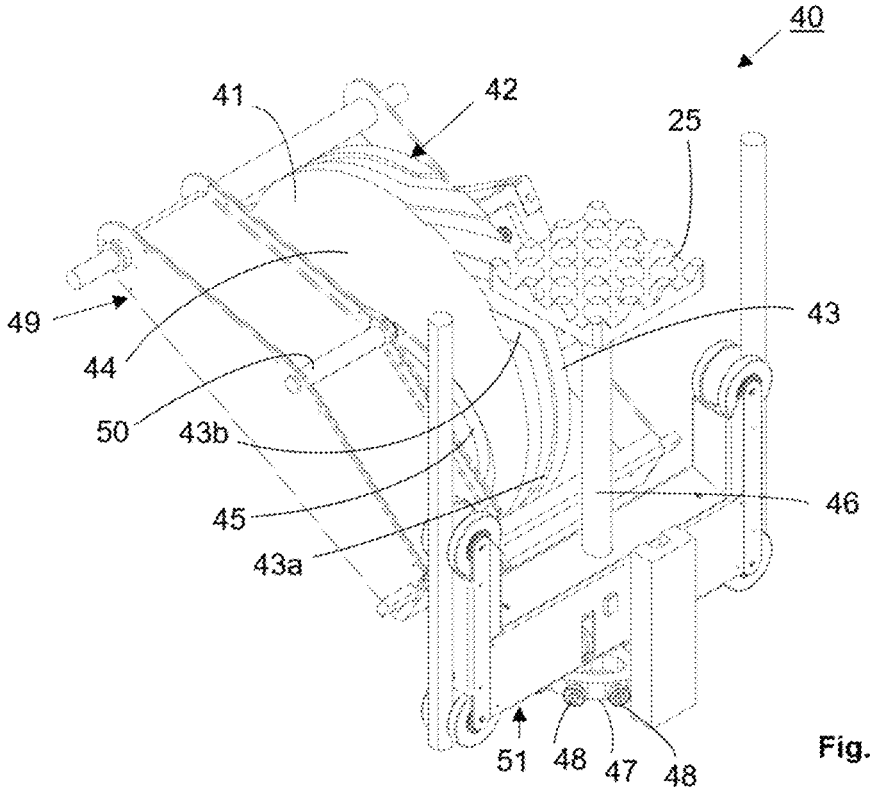
Figure 6A:
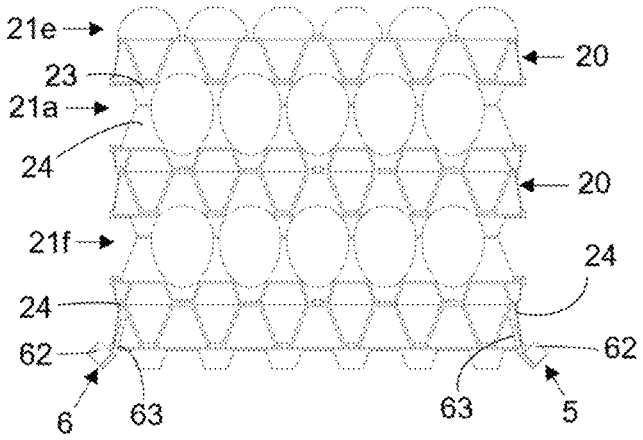
Figure 6B:
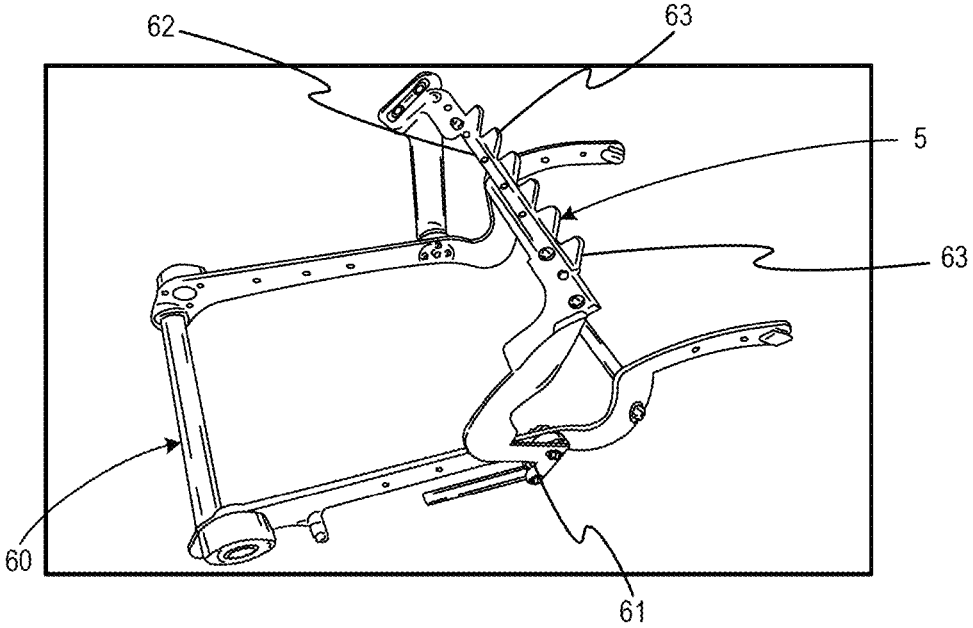
Figure 6C:
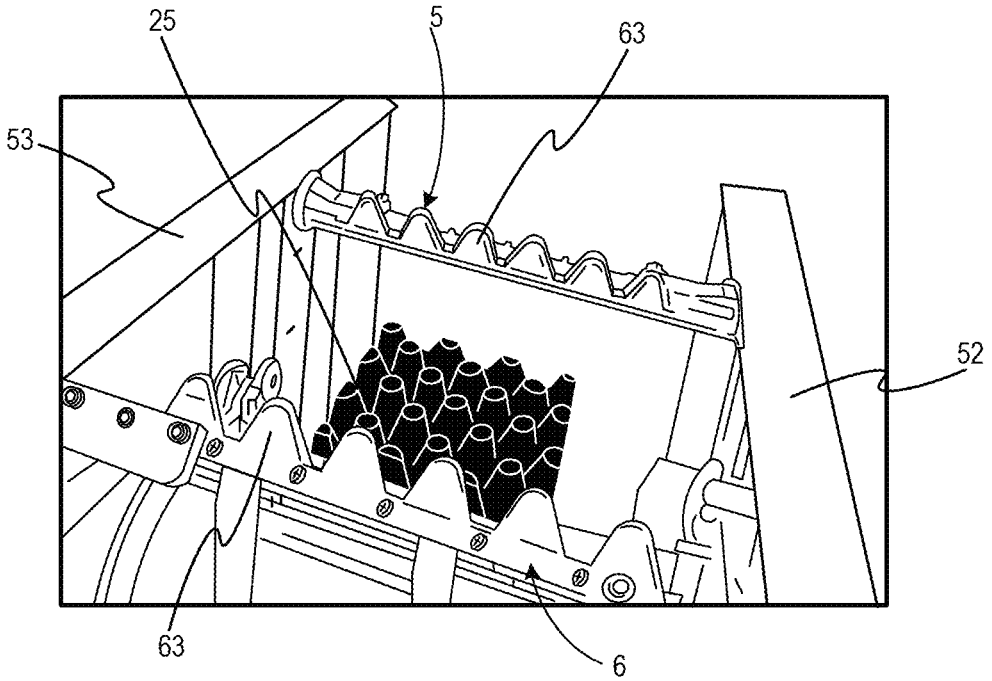
Figure 7A:
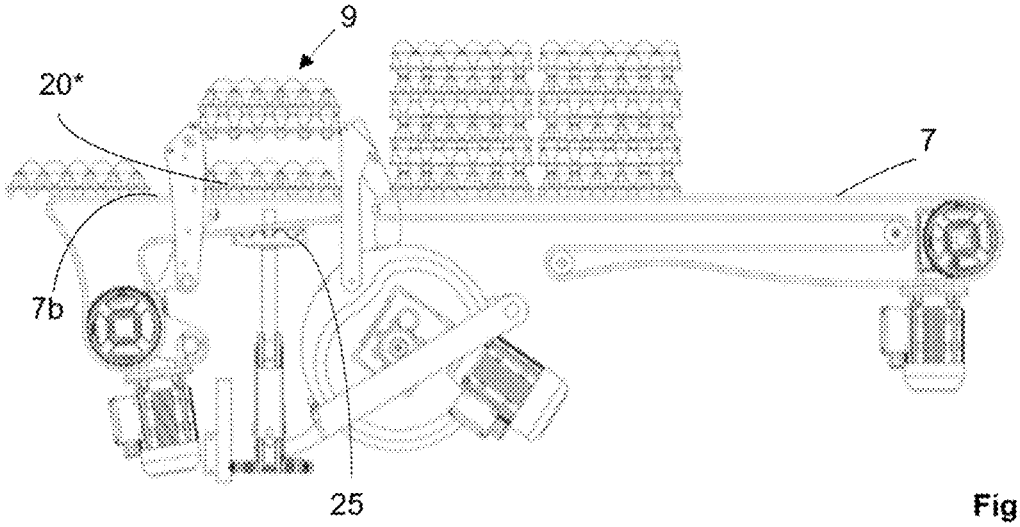
Figure 7B:
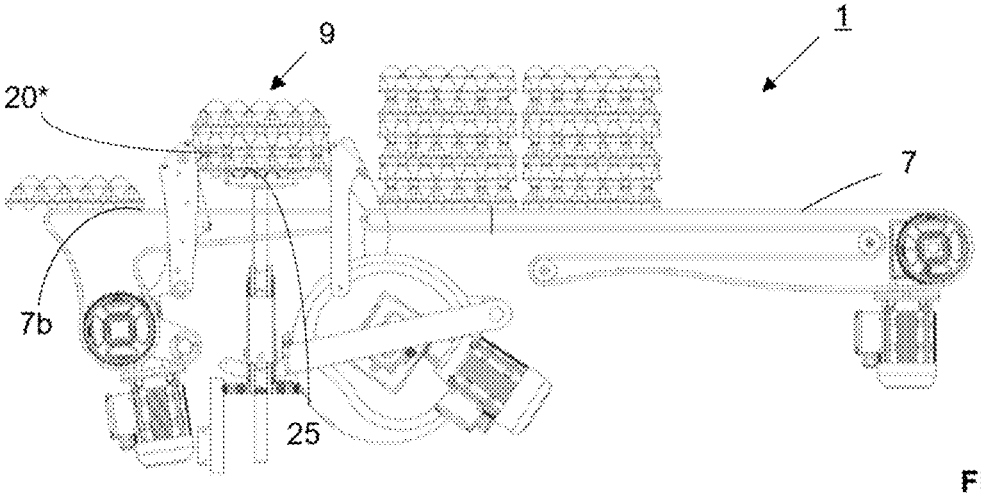
Figure 7C:
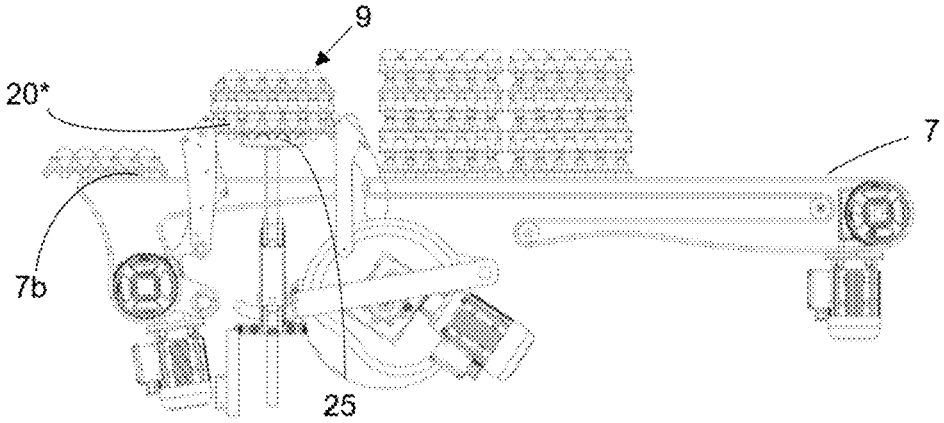
Figure 7D:
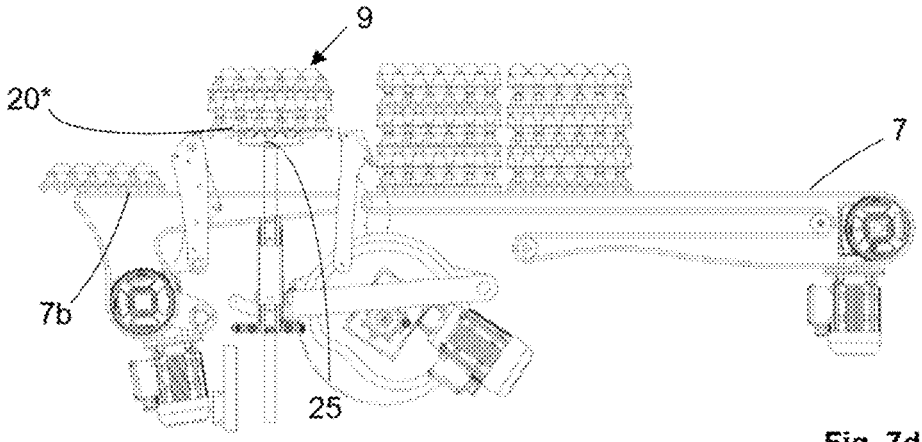
Figure 7E:
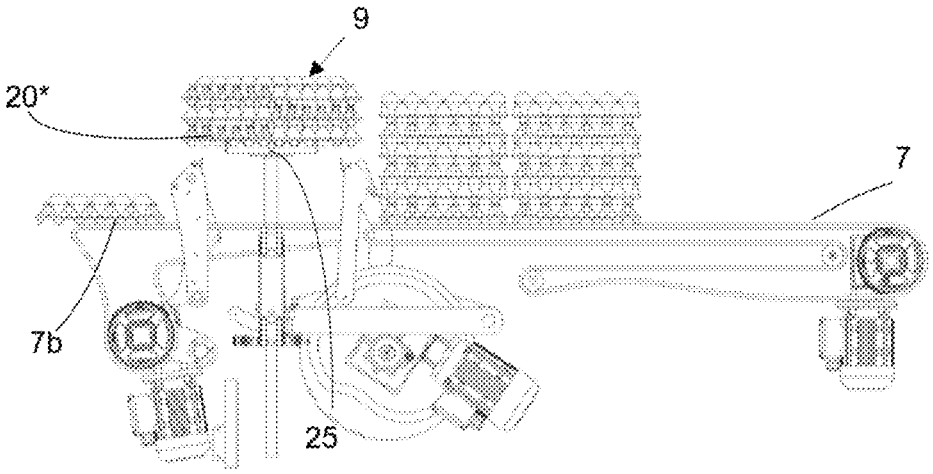
Figure 7F:
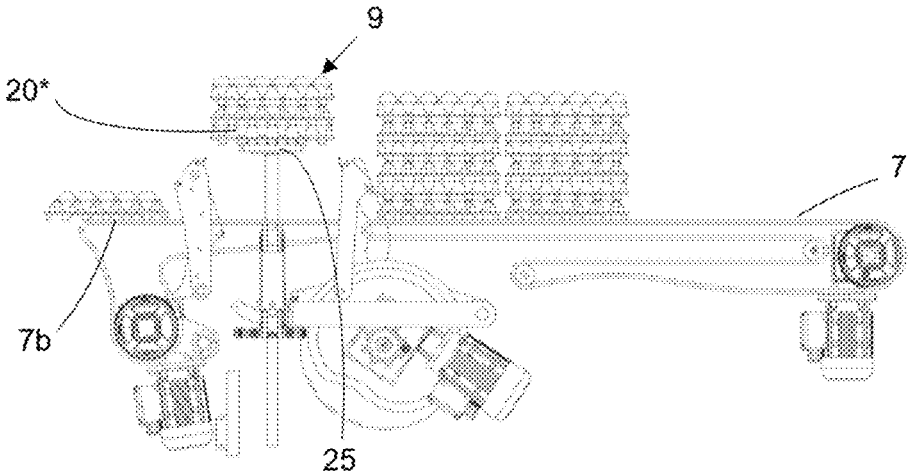
Figure 7G:
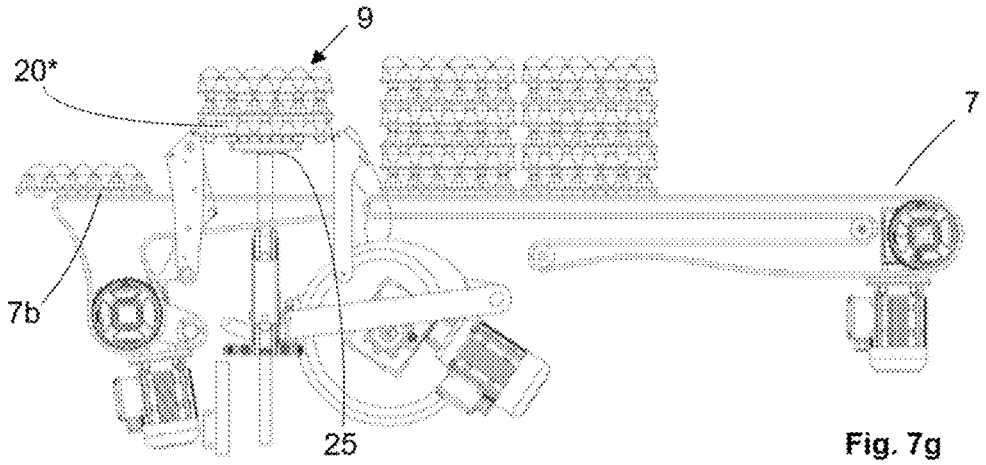
Figure 7H:
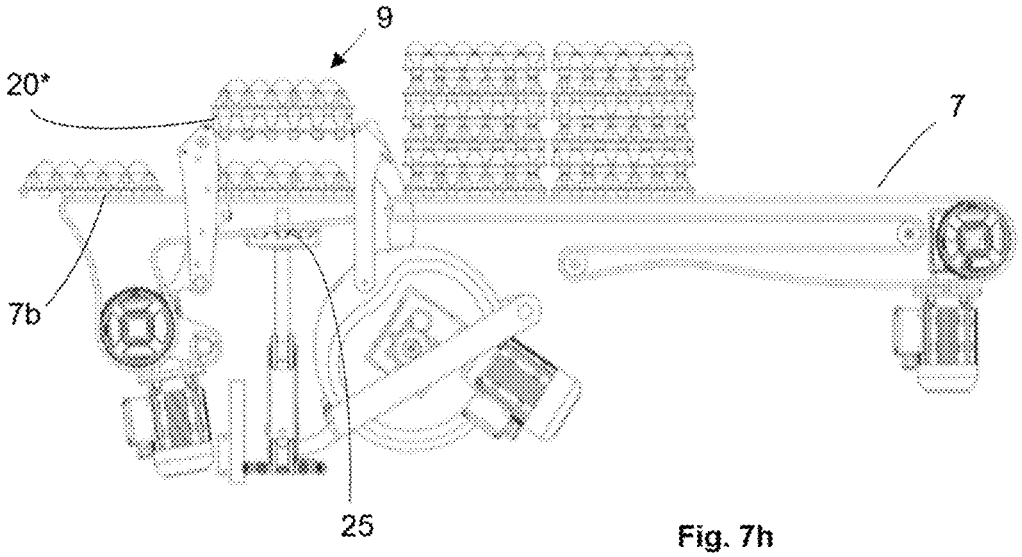
Figure 8A:
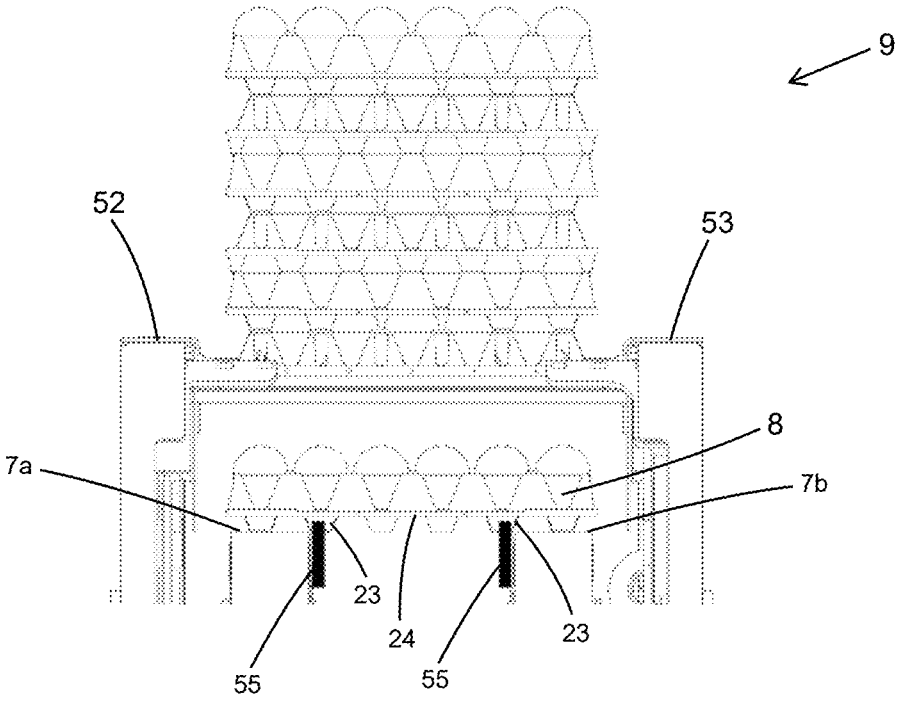

The present invention will be explained in more detail hereunder, referring to an appended drawing of a preferred embodiment of a device according to the present invention. The drawing and the description do not have any limiting effect on the scope of protection of the present invention, which is only limited by the appended claims. The drawing shows:

FIG. 1*a* a perspective view of a stacking device for egg trays, in which a device according to the present invention is incorporated;

FIG. 1*b* a perspective view of the stacking device from FIG. 1*a*, filled with egg trays stacked and to be stacked;

FIG. 2*a* a bottom view of an egg tray;

FIG. 2*b* a bottom view of the egg tray from FIG. 2*a*, turned 90 degrees;

FIG. 3*a* a top view of a platform with upward-projecting projections and supporting points;

FIG. 3*b* a top view of the platform from FIG. 3*a* with upward-projecting projections and supporting points for carrying an egg tray turned 90 degrees;

FIG. 3*c* a top view of a platform with holes extending through the platform and supporting points;

FIG. 3*d* a top view of the platform from FIG. 3*c* with holes extending through the platform and supporting points for an egg tray turned 90 degrees;

FIG. 4*a* a perspective bottom view (rotated 180 degrees) of a platform with upward-projecting projections that engages on an egg tray;

FIG. 4*b* a perspective bottom view (rotated 180 degrees) of a platform with holes extending through the platform that engages on an egg tray;

FIG. 5 a perspective view of a lifting device;

FIG. 6*a* a side view of a stack of egg trays supported by a front and a rear carrier;

FIG. 6*b* a perspective view of a carrying device for carrying egg trays, of which a carrier from FIG. 6*a* forms part;

FIG. 6*c* a perspective view of a part of the stacking device, in which the platform and the carriers can be seen;

FIG. 7*a-h* a side view of an egg stacker in successive steps during the stacking of egg trays; and FIG. 8*a, b* a schematic front view of the lifting device with stacked egg trays during supply of an egg tray and during discharge of a stack of egg trays.

Looking now at the figures, FIGS. 1*a* and 1*b* show, respectively, a perspective view of an empty stacking device 1 for egg trays, in which a device according to the present invention is incorporated, and a perspective view of the stacking device 1, filled with egg trays stacked and to be stacked 8, 9. The stacking device comprises a conveyor belt 2 as supply conveyor that forms part of a supply transport device in which, in a manner known per se, eggs are packed in egg trays. In use, egg trays to be stacked 8, in this case filled with five rows and six columns of eggs, are supplied via conveyor belt 2. The egg trays come into a receiving device 3, where they are brought upward by a lifting device 4 toward stacked egg trays 9 carried by second carrying elements in the form of a front and a rear carrier 5, 6. Egg trays 9 stacked to a desired height are deposited by the lifting device 4 on the conveyor belt 2, with which the separate egg trays are supplied, and the conveyor belt 2 transports the stacked egg trays to a discharge conveyor in the form of a conveyor belt 7, via which the stacked egg trays 9 are led away. The discharge conveyor forms part of a discharge transport device that drives the conveyor belt 7 and by which the stacked egg trays 9 may be fed for example to a palletizing device.

FIGS. 2*a* and 2*b* show a bottom view of an egg tray 20. This egg tray has a matrix pattern of five rows 21*a*-21*e* and six columns 22*a*-22*f* with cups 23, in which eggs are placed during use. Note that, because the underside of an egg tray 20 is shown here, the eggs are located on the side of the figures turned away from the side in view. The egg tray from FIG. 2*b* is shown turned through 90 degrees anticlockwise relative to the egg tray from FIG. 2*a*. Between the cups 23 there are raised portions 24 (in these figures, away from the viewer) which in the case of stacked egg trays 9, carry cups 23 of egg tray 20 stacked thereon. When the egg tray 20 with the orientation from FIG. 2*b* is stacked on the egg tray 20 with the orientation from FIG. 2*a*, the cups 23 from FIG. 2*a* are supported on raised portions 24 of the egg tray 20 from FIG. 2*b*. It is always the cups 23 that are located both in row 21*b*, 21*c* or 21*d* and in column 22*b*, 22*c*, 22*d* or 22*e*, marked in FIGS. 2*a* and 2*b* with a dark dot, which in use come into contact with platform 25, or 30, which is explained in more detail referring to FIGS. 3*a*-3*d*. FIGS. 3*a* and 3*b* show a top view of platform 25 for carrying and for raising and lowering egg trays. The flat base surface 26, and the projections 27 with their base 28 and flat upper surface 29 of the platform 25 can be seen in the top view. In FIGS. 3*a* and 3*b*, contact points in the base surface, which in use come into contact with cups 23 of an egg tray, are also marked with black dots. The platform 25 is shown in FIGS. 3*a* and 3*b* in the same orientation with supporting points shown for an egg tray 20 that is turned 90 degrees. In use, in the stacking device that is described in this document, the egg trays 20 are always supplied oriented identically and it is the platform 25 that, turned 90 degrees every time, engages on the next egg trays 20. The platform 25 may of course also be used with stacking devices wherein egg trays 20 are supplied turned 90 degrees every time.

FIGS. 3*c* and 3*d* show a top view of platform 30 for carrying and for raising and lowering egg trays. The flat base surface 31 and the through holes 32 in the platform 30 can be seen in the top view. In FIG. 3*c*, the holes 32*a* in the base surface, which in use receive cups 23 of an egg tray 20, are marked with black lines. In FIG. 3*d*, the holes 32*b* in the base surface, which in use receive cups 23 of an egg tray 20, are marked with black lines. The platform 30 is shown in FIGS. 3*c* and 3*d* in the same orientation with supporting points shown for an egg tray 20 that is turned 90 degrees. In use, in the stacking device that is described in this document, successive egg trays 20 are always supplied oriented identically and it is the platform 30 that, turned 90 degrees every time, engages on the next egg trays 20. The platform 30 may of course also be used with stacking devices wherein egg trays 20 are supplied turned 90 degrees every time. Instead of through holes, blind holes may also be provided in platform 30, which are at least formed so that cups of egg trays can be received therein.

FIG. 4*a* shows a perspective bottom view (rotated 180 degrees) of the platform 25 that supports an egg tray 20 (because the arrangement is photographed upside down, the bottom ends of the eggs do not come into contact with the cups. It should be clear, however, that if the arrangement is reversed and the egg tray 20 is located on platform 25, the eggs rest in the cups 23). It can be seen in this figure that some cups 23 of the egg tray 20 rest on the flat base surface 26 of the platform 25. On their side, the projections 27 of the egg tray 20 relative to the platform 25 help centering (or vice versa), not only in the state in which the egg tray 20 rests completely on the platform 25, but certainly also while bringing the platform 25 under the egg tray 20. The upper surfaces of the projections 27 do not come into contact with the egg tray 20.

FIG. 4*b* shows a perspective bottom view of a platform 30 with holes 32*a*, 32*b* extending through the platform 30 that supports an egg tray 20. It can be seen in this figure that some cups 23 of the egg tray 20 rest on the edges of holes 32*a* of the platform 30. The holes 32*a* center the cups 23 of the egg tray 20 relative to the platform 30, not only in the state in which the egg tray 20 rests completely on the platform 30, but certainly also while bringing the platform 30 under the egg tray 23.

Since the principle of the action of a lifting device with a platform 30 with holes extending through the platform corresponds to that of a platform 25 with upward-projecting projections, the description of the action is not always repeated every time in the embodiment examples.

FIG. 5 shows a perspective view of a lifting device 40. The lifting device 40 has a driven guide wheel 41 rotating, or at least rotatable, about a rotation axis 50. The guide wheel 41 is of solid configuration in this embodiment example. On the periphery of the guide wheel 41 there is a running surface 42, the distance (diameter) of which to the rotation axis of the guide wheel 41 displays a jump. In the running surface 42 there is a slot 43, which extends (43*a*) from an abrupt increase in diameter in the peripheral direction centrally in the running surface 42 of the guide wheel 41 and is then deflected slanting (43*b*) toward the outside of the running surface 42. In the side surface 44 of the guide wheel 41 there is an oval groove 45.

A platform 25 is carried by a lifting element in the form of a rod 46. Underneath the rod 46 there is a cam wheel 47 extending at right angles to the rod 46, with cams 48, which project outwards in the plane of the cam wheel 47. Next to the side of the guide wheel 41 there is a rocker arm 49 with an axis 50 that extends at right angles to the plane of the guide wheel 41 into the oval groove 45. The rocker arm 49 is connected to a transmitting device 51 that carries the rod 46 with the cam wheel 47.

When guide wheel 41 rotates, the rocker arm 49 performs a rocking motion, which is converted via transmitting device 51 to a vertical up and down motion of the rod 46 with the platform 25 and the cam wheel 47. When the rod 46 and the platform 25 are at, or at least near, the highest point, the slot 43 of the guide wheel 41 engages on one of the cams 48 of the cam wheel 47. When the guide wheel 41 then turns further, the deflection 43*b* moves the respective cam 47 sideways, so that rod 46 with platform 25 is turned through 90 degrees. Then the guide wheel 41 turns further again, so that the rocker arm 49 moves the rod 46 down again via the transmitting device 51.

FIG. 6*a* shows stacked egg trays 9 in side view. It can be seen in FIG. 6 that the egg trays 20 stacked on one another are oriented relative to each other turned a quarter turn, i.e. 90 degrees every time. Of the upper egg tray 20, only the outermost row 21*e* of eggs can be seen. In the egg tray 20 located thereunder, the outermost column 22*a* of eggs can be seen. In the egg tray 20 located thereunder, the outermost row (21*a*, not visible in FIG. 6*a*) of eggs is obstructed behind the superjacent egg tray 20. In the egg tray 20 located thereunder, again an outermost column 22*f* of eggs is visible. The bottom egg tray is carried by a front carrier 5 and rear carrier 6, which are shown in more detail in FIG. 6*b*.

FIG. 6*b* shows a perspective view of a carrying device 60 for carrying egg trays 20. The carrying device 60 has a frame 61 that supports a carrier 5. During the steps for the stacking of egg trays 20, the frame 61 moves to and fro horizontally relative to the stacked egg trays 9, as will be explained in more detail later. It can clearly be seen that the front carrier 5 comprises a transverse beam 62 and lips 63 slanting upward, extending from the transverse beam 62. The lips 63 correspond in shape substantially with the raised portions (24, not shown in FIG. 6*b*) on the edge of an egg tray 20. The slanting form of the lips 63 corresponds substantially to the angle of projections (24, not shown in FIG. 6*b*) of an egg tray 20. The shape of the lips may be adapted to the egg trays to be carried.

Now looking again at FIG. 6*a*, the transverse beam 62 and the outer lip 63 of front and rear carriers 5, 6 are visible. The lips 63 engage on inner sides of raised portions 24 of the bottom egg tray 20, so that the egg tray 20 can be carried reliably by the lips 63 over a relatively large area thereof, at least in comparison with a known device wherein the bottom egg tray 20 only rests with the underside of the edge of the egg tray 20 on a horizontal strip FIG. 6*c* shows a perspective view of a part of the packaging device 1, in which the platform 25 and the carriers 5, 6 are visible. The platform 25 has a smaller area than a passage that is defined by the carriers 5, 6 and by lateral edges 52, 53 of the discharge transport device 54. The shape of the lips 63 of carriers 5, 6 can also be seen in FIG. 6*c*.

FIGS. 7*a*-*h* show a side view of a packaging device 1 for eggs in successive steps during the stacking of egg trays 20. In particular, it follows the movement of egg tray 20* during the successive steps.

FIG. 7*a* shows an initial state of the packaging device 1. The egg tray filled with eggs 20* is brought via conveyor belt (not shown in FIG. 7) and a first 7*a* and second 7*b* conveyor into the receiving device 3. The egg tray 20*, just like the "next" egg tray 20 to be stacked after egg tray 20*, is oriented with the rows 21 of eggs in the longitudinal direction or transport direction of the conveyor belt. The platform 25 of the lifting device 40 is located at a distance directly under the egg tray 20*. Egg tray 20* is located directly under stacked egg trays 9. The orientation of the bottom egg tray 20 of the stacked egg trays is turned 90 degrees relative to egg platform 20*.

FIG. 7*b* shows the next step. Egg tray 20* is gripped by the platform 25 on the underside and brought upward, so that the egg tray 20* engages with the upper side on the "previous" egg tray 20, stacked one cycle earlier. The cups 23 of the previous egg tray are supported on the raised portions 24 of egg tray 20*. The front 5 and rear 6 carrier under the previous egg tray 20 can now be removed, because egg tray 20* and the egg trays stacked above that are carried by the platform 25.

It can be seen in FIG. 7*c* that the carriers 5, 6 are in fact moved aside, so that egg tray 20* can pass through a passage defined by side walls of the discharge transport device and carriers 5, 6.

It can be seen in FIG. 7*d* that the stacked egg trays 9, of which egg tray 20* now forms part, are brought further upward by platform 25, so that the stacked egg trays 9 and the platform 25 project above the rest of the packaging device 1.

It can be seen in FIG. 7*e* that platform 25 with stacked egg trays 9 thereon is rotated through an angle of 45 degrees.

In FIG. 7*f*, the platform 25 is rotated 90 degrees relative to FIG. 7*d*. Egg tray 20* is located at the bottom and is now oriented with the rows 21 of eggs at right angles to the original orientation and so also to the transport direction. Egg tray 20* now has the same orientation as the egg tray 20 which in FIG. 7*a* was located at the bottom of the stacked egg trays 9. Thus, the next egg tray 20 with the rows in the transport direction can be stacked under egg tray 20*.

In FIG. 7*g*, the carriers 5,6 are moved again to their starting position and platform 25 moves downward, wherein the carriers 5, 6 engage in raised portions 24 of egg tray 20*, so that the stacked egg trays 9 are again carried reliably.

In FIG. 7*h*, the state of the packaging device corresponds to the state that is shown in FIG. 7*a*, but the stack of egg trays is now stacked one layer higher, because egg tray 20* now forms the lowest egg tray. The cycle can now be repeated, until the desired number of egg trays 20 is stacked. Each cycle of steps 7*a*-7*g* is the same, at least with regard to the movements of the lifting device.

When the stack of egg trays has reached a desired height, after the last egg tray forms part of the stacked egg trays 9, the transverse beams 62 remain in an open state, so that the lips 63 thereof do not engage on the lowest egg tray. The platform 25 still rotates of course through 90 degrees after the last egg tray is placed under the already stacked egg trays 9. The lifting device 4 with the stacked egg trays 9 drops downward and deposits the stacked egg trays 9 on the conveyor belt, in this case the partial conveyors 7*a*, 7*b* which supplied the last (lowest) egg tray. The partial conveyors transport the stacked egg trays 9 further in the transport direction under the stacking device thereof, so that a new cycle can begin.

Figure 8B:
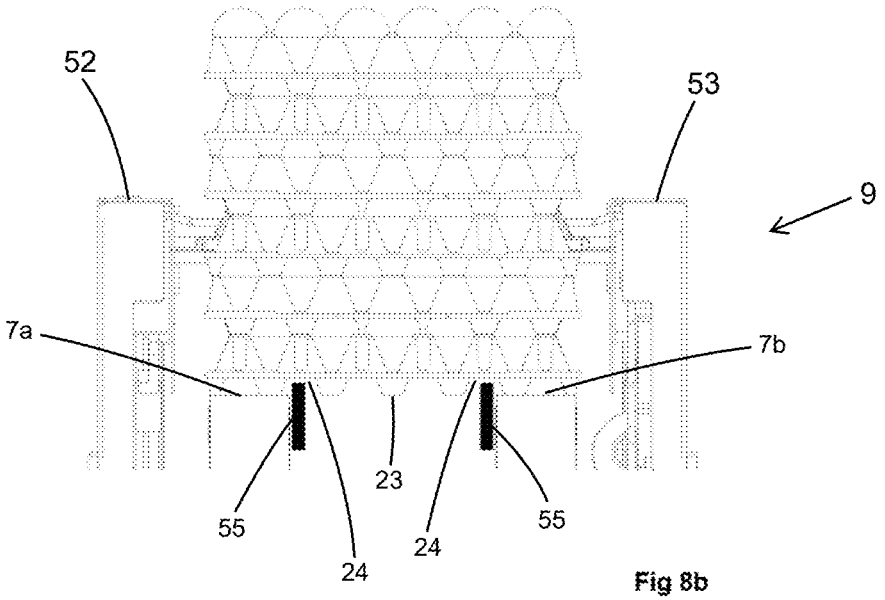

FIGS. 8*a* and 8*b* show a schematic front view of the lifting device with stacked egg trays 9, supplying an egg tray 8, or discharging stacked egg trays 9, wherein the action of the vertical elements, in this case in the form of cams 55, blocks the passage for an egg tray 8, and keeps it open for stacked egg trays 9. FIG. 8*a* shows an egg tray 8 supplied by partial conveyors 7*a*, 7*b*. Cams 55 extend above the partial conveyors 7*a*, 7*b*, so that they are located in the conveyor track of the egg tray 8. The cams 55 block egg tray 8 because they are located in the path of respective cups 23 of the egg tray. Whereas the partial conveyors 7*a*, 7*b* run continuously, the egg tray 8 is stationary and then, as described above, is gripped by platform 25 and is brought upward.

After the stacked egg trays 9 have reached the desired height, platform 25 carries the stacked egg trays 9 downward in order to deposit the stacked egg trays 9 on the partial conveyors 7*a*, 7*b*, see FIG. 8*b*. Because during stacking the lowest egg tray is rotated 90 degrees every time after it has engaged with the egg tray located above it, the lowest egg tray is, when deposited on the partial conveyors 7*a*, 7*b*, in another orientation than during feed of said egg tray. This is clearly visible in FIG. 8*b*, wherein the cams 55, which are still in the same place, are positioned just between the cups 23 of the lowest egg tray. Because the partial conveyors 7*a*, 7*b* are still running, they engage on the stacked egg trays 9 and move them in the transport direction further. The raised portions 24 in the lowest egg tray form as it were a tunnel, so that the egg tray can pass the cams 55 without any problem. It should be made clear that the action is the same if a third partial conveyor (not shown here) also extends between the cams 55.

The present invention is described above only with reference to one embodiment example thereof. It should be made clear that many variants are conceivable within the scope of protection of the invention, which is defined by the claims presented hereunder.

It is important for a reader, and for determining the scope of protection of the device, to realize that the invention is explained in the figures and the description with the aid of an egg tray for 30 eggs (a matrix of five rows and six columns), but that egg trays with some other configuration may also be stacked with said device. This also applies to application of the method. Thus, for example trays with a matrix of four by five cups may also be processed with the same packaging device and according to one and the same method. At most, some dimensions in the device have to be adjusted. The same applies to a platform. The shape of a platform can be adapted, so long as the platform has sufficient carrying area to carry an egg tray reliably and has the pattern of projections comparable to the pattern shown and described in this document. The mutual distance between the projections may be increased or reduced in proportion as there are egg trays with a comparable increased or reduced pattern to be processed.

LIST OF REFERENCE NUMBERS

1 packaging device for eggs
2 conveyor belt
3 receiving device
4 lifting device
5 front carrier
6 rear carrier
7 conveyor belt
7*a*, 7*b* partial conveyor
8 egg tray to be stacked
9 stacked egg trays
20 egg tray
21*a-e* rows of egg cups
22*a-f* columns of egg cups
23 cup of egg tray
24 raised portion of egg tray
25 platform
26 base surface
27 projection
28 base
29 upper surface
40 lifting device
41 guide wheel
42 running surface of guide wheel 41
43 slot
43*a* right portion of slot 43
43*b* deflection of slot 43
44 side surface
45 groove
46 rod
47 cam wheel
48 cam
49 rocker arm
50 axis of rocker arm
51 transmitting device
52 lateral edge of discharge transport device
53 lateral edge of discharge transport device
54 discharge transport device
55 cam
60 carrying device
61 frame of the carrying device
62 transverse beam
63 lip

The invention claimed is:

1. A stacking device that is suitable for the stacking of substantially square egg trays, supplied, or at least to be supplied, via a supply conveyor in a supply transport direction under a stacking location, and to be discharged via a discharge conveyor in a discharge transport direction from the stacking location, comprising:

a receiving device, configured for the successive receiving and carrying of egg trays filled with eggs delivered by the supply conveyor, said receiving device comprising a transit space that is suitable for moving a platform through it, and which is defined on at least two sides by first carrying elements, which, in use, carry edges of an egg tray corresponding to the first carrying elements, a stacking device located above the receiving device at the stacking location, comprising a passage extending substantially in a horizontal plane that is suitable for transporting the platform loaded with an egg tray through it, and that is located above the receiving space, and is defined on at least two sides extending parallel to each other by movable second carrying elements, which during use carry, with the second carrying elements, corresponding edges of an egg tray, and which are configured for increasing and reducing the passage, a lifting device, comprising a platform extending at least substantially horizontally, carried by a carrying device configured for bringing an egg tray upward from the receiving device, wherein the platform has dimensions such that it can pass through the transit space and the passage, wherein the stacking device is configured to cause an egg tray filled with eggs, brought upward from the receiving device by means of the lifting device, to engage with an upper side of the egg tray on an underside of a further egg tray located in the stacking device, then causing the second carrying elements to move in such a way that the egg tray can pass through the passage, then bringing the lifting device with the egg tray(s) thus carried by the platform further upward and then causing the second carrying elements to reduce the passage so that when the lifting device is moved downward, the egg tray is carried by the second carrying elements, characterized in that the second carrying elements extend at least substantially horizontally and at right angles to the discharge transport direction and are configured to move in a horizontal plane in the transport direction away from each other and toward each other.

2. The stacking device as claimed in claim 1, wherein the second carrying elements are elongated.

3. The stacking device as claimed in claim 1, wherein the second carrying elements have a longitudinal direction that extends at right angles to the discharge transport direction and a transverse direction which, seen from bottom to top, extend slanting toward each other.

4. The stacking device as claimed in claim 1, wherein the second carrying elements have, on a side extending slanting upward, a profile corresponding to an inside of a lateral edge of an egg tray.

5. The stacking device as claimed in claim 1, wherein two first carrying elements extend in the supply transport direction.

6. The stacking device as claimed in claim 1, wherein the platform has a rectangular, preferably square perimeter.

7. The stacking device as claimed in claim 1, wherein the perimeter of the platform has a length and a width, each of which is less than 400 mm, wherein the length and/or width is preferably less than 250 mm, more preferably less than 220 mm.

8. The stacking device as claimed in claim 1, wherein the platform is provided, on an upper side thereof, with upward-projecting projections, which are configured for being able to engage, in two positions turned 90 degrees about a vertical axis, with an underside of an egg tray that is to be carried.

9. The stacking device as claimed in claim 1, wherein the carrying device comprises an elongated lifting element extending vertically, provided on the underside of the platform.

10. The stacking device as claimed claim 1, wherein the carrying device is configured to rotate the platform about a vertical axis.

11. The stacking device as claimed in claim 1, wherein the discharge transport device comprises an endless belt.

12. The stacking device as claimed in claim 1, wherein the receiving device and/or the stacking location extend at least substantially in a horizontal plane.

13. The stacking device as claimed in claim 1, wherein the supply conveyor comprises at least first and second partial conveyors extending at a distance from and parallel to each other, or wherein the supply conveyor comprises three parallel belts, separate from each other, extending parallel to each other through a space, and wherein, between the first and second partial conveyors, or in the two spaces, there are two vertical elements, which in a first supply orientation of an egg tray function as a stop for two cups of the egg tray, and which, in a second discharge orientation of an egg tray, turned 90 degrees relative to the first orientation, are located between two adjacent cups, so that a supplied egg tray is stopped by the vertical elements to be gripped by the lifting device, and stacked egg trays deposited by the lifting device can pass the vertical elements unhindered.

14. The stacking device as claimed in claim 13, comprising the at least first and second partial conveyors extending at a distance from and parallel to each other, wherein the vertical elements comprise cams that are hinged toward each other so that in the hinged state they allow egg trays to pass unhindered over the supply conveyor direction of the discharge conveyor.

15. The stacking device as claimed in claim 13, comprising a third partial conveyor that is configured to be placed between the first and second partial conveyors for forming an at least substantially continuous conveyor belt extending transversely to a transport direction of the supply conveyor.

16. The stacking device as claimed in claim 14, wherein the vertical elements, in the stated state hinged toward each other, are located under the level of belts of the partial conveyors.

17. A method for stacking egg trays, comprising the steps of:

supplying an egg tray filled with eggs to a receiving device located under a stacking location of a stacking device and comprising a passage, said receiving device comprising a transit space that is suitable for moving a platform through it, and which is defined on at least two sides by first carrying elements, which, in use, carry edges of an egg tray corresponding to the first carrying elements, moving the egg tray upward toward the stacking device by means of a lifting device, comprising a platform extending at least substantially horizontally, carried by a carrying device, with dimensions such that it can pass through the transit space and the passage, transporting the platform loaded with an egg tray through the passage, wherein the passage, on at least two sides extending parallel to each other, is defined by movable second carrying elements in order to carry edges of an egg tray corresponding to the second carrying elements, causing the egg tray filled with eggs brought upward by means of the lifting device, to engage with an upper side of the egg tray on an underside of a further egg tray located in the stacking device, causing the second carrying elements to move in such a way that the egg tray can pass through the passage, by means of the lifting device, bringing the egg tray carried by the platform further upward, reducing the passage by means of the second carrying elements, moving the lifting device downward, and transferring the egg tray to the second carrying elements, so that it is carried by the second carrying elements, characterized in that the second carrying elements extend at least substantially horizontally and at right angles to the discharge transport direction and, for increasing and reducing the passage, move in a horizontal plane in the transport direction away from each other and toward each other.

18. The method as claimed in claim 17, wherein the egg trays are stacked by means of a stacking device.

* * * * *